US006585526B2

(12) United States Patent
Gillenberg et al.

(10) Patent No.: US 6,585,526 B2
(45) Date of Patent: Jul. 1, 2003

(54) ELECTRICAL CONNECTOR HAVING MOVEABLE SIDE WALLS FOR ACCOMMODATING A SECOND ELECTRICAL CONNECTOR

(75) Inventors: Eric Gillenberg, Speyer (DE); Johan Vanbesien, Leper (BE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 09/976,371

(22) Filed: Oct. 12, 2001

(65) Prior Publication Data

US 2002/0090841 A1 Jul. 11, 2002

(30) Foreign Application Priority Data

Oct. 13, 2000 (DE) ..... 100 50 779

(51) Int. Cl.[7] ..... H01R 12/00
(52) U.S. Cl. ..... 439/65
(58) Field of Search ..... 439/65, 260, 593

(56) References Cited

U.S. PATENT DOCUMENTS 5,919,057 A 7/1999 Kameyama ..... 439/364

FOREIGN PATENT DOCUMENTS

| | | |
|---|---|---|
| DE | 19958695 A1 | 6/2001 |
| EP | 0 571 037 A1 | 11/1993 |
| JP | 11067346 | 3/1999 |
| WO | WO 00/30220 | 5/2000 |

OTHER PUBLICATIONS

European Search Report.

*Primary Examiner*—Renee Luebke
*Assistant Examiner*—Ann McCamey

(57) ABSTRACT

The invention describes an electrical connector having a multitude of adjacent contacts and side walls. At least part of the side walls are flexibly moveable, and the side walls are positioned so that they surround at least part of the contact element region. Because of the flexibility of the side walls, an electrical connector of this type can be connected to a second electrical connector under any circumstances and without any problems.

10 Claims, 1 Drawing Sheet

ELECTRICAL CONNECTOR HAVING MOVEABLE SIDE WALLS FOR ACCOMMODATING A SECOND ELECTRICAL CONNECTOR

FIELD OF THE INVENTION

The present invention relates to an electrical connector, and more specifically, to an electrical connector with a multitude of adjacent and/or superimposed contacts and side walls surrounding at least part of the contact element region.

BACKGROUND OF THE INVENTION

Conventional electrical connector systems, as shown in FIG. 3, consist of a first connector 1 mounted on a first electrical printed circuit board (not shown in figure) and a second connector 2 mounted on a second electrical printed circuit board 3. The connectors in each case comprise a multitude of contact elements that come into contact with each other when the connectors are mated, enabling an electrical connection between the circuit boards.

The contacts of the first connector, or more precisely, the contact region containing the contacts, is surrounded by side walls. The side walls act as a guide to ensure that corresponding connector contacts engage during the mating of the connectors.

The second connector consists of two connector halves 2*a* and 2*b* that are mounted on opposite sides of the second circuit board. This arrangement is advantageous in that a particularly high number of contacts can be accommodated in the available space. On the other hand, problems are commonly encountered when the connectors are being mated, in particular due to tolerances of the thickness of the second circuit board. As a result, it is difficult to join the first and second connectors to establish an electrical connection between the circuit boards.

SUMMARY OF THE INVENTION

An object of the present invention is to develop a board mounted electrical connector that can be mated with a second electrical connector under circumstances where the board thickness varies within a tolerance.

This and other objects of the present invention are achieved by providing an electrical connector that has a multitude of adjacent contacts and side walls. At least part of the side walls are flexibly moveable, and the side walls are positioned so that they surround at least part of the contact region.

Partially due to the flexible design of the side walls, electrical connectors, which are not dimensioned or arranged according to exact specifications, can be duly guided to a second electrical connector. As a result, the need to exactly adjust the measurements of the second electrical connector which is to be brought into contact with the first electrical connector, and hence also the measurements of the circuit board or of another device on which the second electrical connector is mounted, can fluctuate to a relatively large extent, without jeopardising the regulatory mating ability of the connectors.

Other advantages, and novel features will become apparent from the following detailed description of the invention when considered in conjunction with the accompanying drawings.

DETAILED DESCRIPTION OF THE PREFERRED EMBODIMENT

Figure 1:
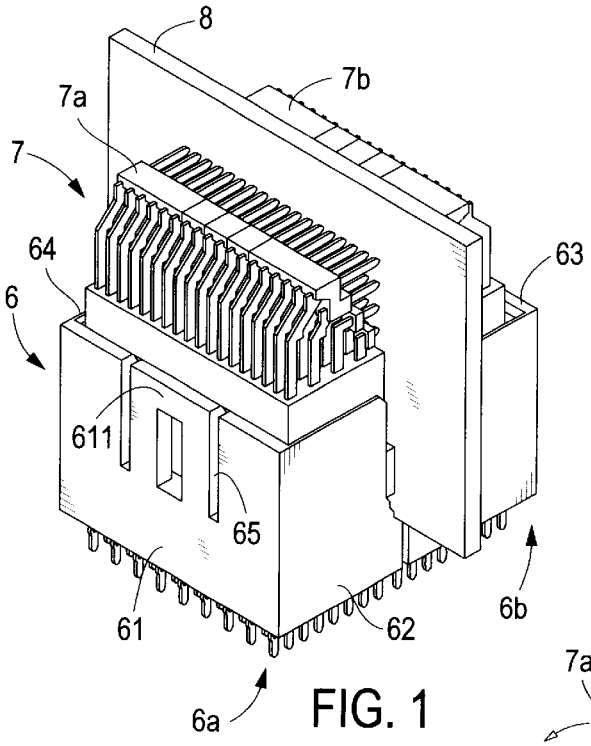
FIG. 1 is a perspective view of the electrical connector arrangement of the present invention wherein a first electrical connector and a second electrical connector mounted on a circuit board are mated.
Figure 2:
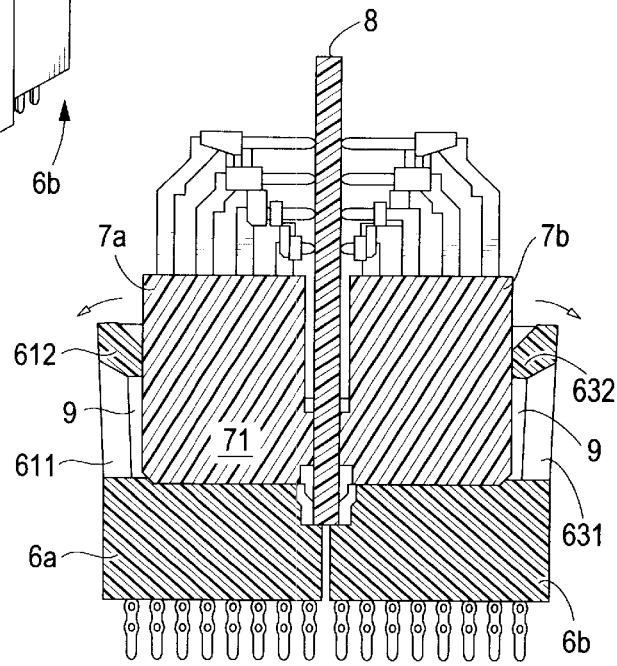
FIG. 2 is a sectional view of the arrangement shown in FIG. 1.
Figure 3:
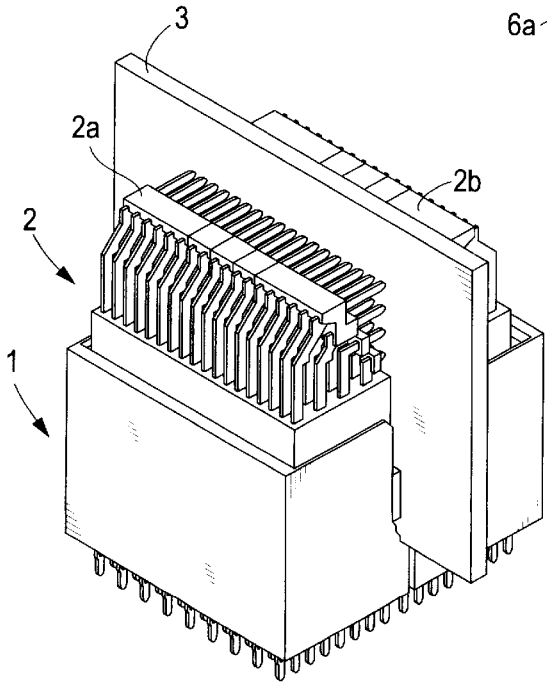
FIG. 3 PRIOR ART
FIG. 3 is a perspective view of a known conventional electrical connector arrangement wherein a first electrical connector and a second electrical connector mounted on a circuit board are mated.

Referring to the drawings, FIG. 1 and FIG. 2 illustrate a preferred embodiment of the electrical connector of the present invention. The electrical connector has a first connector 6 mounted on a first circuit board (not shown) and a second connector 7 mounted on a second circuit board 8.

The second connector 7 consists of two identically constructed connector halves 7*a* and 7*b*. The second connector halves 7*a* and 7*b* are arranged on opposite sides of the second circuit board 8.

The first connector 6 consists of two identically constructed connector halves 6*a* and 6*b*. The first connector halves 6*a* and 6*b* are arranged opposite each other on the same side of the first circuit board (not shown).

The first or second connectors 6 or 7, however, need not consist of identically constructed connector halves. In particular, there is no need for each connector half 6*a*, 6*b* to comprise identically constructed and identically arranged contacts. It would be possible to design at least the first connector 6 as an integral unit.

The first connector 6 has a multitude of contacts (not shown). The contacts are arranged adjacent to each other in several rows or columns. The contacts of the first connector 6 consist of contact pins, but could also consist of contact sockets or other contacts, such as surface contacts.

Side walls 61, 62, 63, and 64 surround the contact region. At least parts of the side walls 61, 62, 63, and 64 are flexibly moveable. The flexibly moveable parts of the side walls 61, 62, 63, and 64 are indicated by reference numerals 611 and 631. The flexibly moveable parts 611 and 631 run parallel to the second circuit board 8. The flexibly moveable parts 611 and 631 are separated from the rest of the side walls 61 and 63 by slots 65. The flexibly moveable parts 611 and 631 have catches 612 and 632 preferably at their upper end, which extend into the region surrounded by side walls 61, 62, 63, and 64.

The side walls 61, 62, 63, and 64 of the first connector 6 and the flexibly moveable parts 611 and 631 are designed and arranged such that the front end 71 of the second connector 7 comes to lie in the region of the first connector 6 which is surrounded by the side walls 61, 62, 63, and 64 when mated with the first connector 6.

The flexible parts 611 and 631 of the side walls 61 and 63 will react differently when the connectors are mated depending on the thickness of the second circuit board 8 and the measurements of the first and second connectors 6 and 7.

In one example, a second circuit board 8 of a standard specified thickness, and first and second connectors 6 and 7 of standard specified measurements are mated between the side walls 61 and 63 running parallel to the second circuit board 8 and the second connector 7. In this case, the flexible parts 611 and 631 of the side walls 61 and 63 are pushed outwardly by the second connector 7 leaving a large intermediate space 9. No space or only a very small space is left between the side walls 62 or 64 and the second connector 7.

With maximum measurements of the first connector 6, minimal measurements of the second connector 7, and minimal thickness of the second circuit board 8, the flexible parts 611 and 631 of the side walls 61 and 63 are not pushed out as much, but still move outwardly by the second connector 7 or at least make contact.

With minimal measurements of the first connector 6, maximum measurements of the second connector 7, and with maximum thickness of the second circuit board 8, mating of the second connector 7 with the first connector 6 is still possible.

As a result, the second connector 7, irrespective of the size and size ratio of the first connector 6 and the second connector 7, and irrespective of the thickness of the second circuit board 8, is guided by the flexibly moveable parts 611 and 631 of the side walls 61 and 63, more precisely, by the catches 612 and 632 provided on the movable parts 611 and 631. In this way, the contacts of the second connector 7 are guided reliably to each allocated contact of the first connector in all circumstances.

Similarly, an electrical connector of the type described above can always be duly mated with a matching second electrical connector under any circumstances and without any problems, irrespective of the tolerance variations.

The present invention was described in detail above with reference to a preferred embodiment. This embodiment, however, is merely an example. The present invention is not limited to such an embodiment. The features of the first connector can also be used with any other electrical connectors. Also, it can be foreseen, that side walls 62 and 64, that run perpendicular to the second circuit board 8, can have flexibly moveable parts similar to the flexibly moveable parts 611 and 631. In this case, the connectors can also be brought into contact with laterally displaced connector halves 7*a* and 7*b*.

What is claimed is:

1. An electrical connector comprising:

a first electrical connector having a plurality of adjacent contacts disposed in a contact region and a side wall which substantially surrounds the contact region having one or more parts that are flexibly moveable, the one or more parts tat are flexibly moveable are arranged such that during mating with a second electrical connector the one or more parts that are flexibly moveable come into contact with the second electrical connector and are pushed aside by the second electrical connector;

the first electrical connector being arranged on a first circuit board for connection with a second electrical connector mounted on a second circuit board; and, the second electrical connector having two halves arranged opposite each other on opposing sides of the second circuit board.

2. The electrical connector according to claim 1, wherein the side wall has a part that is not flexibly moveable and is arranged such that when the first electrical connector and the second electrical connector are mated, an intermediate space is left between the not flexibly moveable part of the side wall of the first electrical connector and the second electrical connector.

3. The electrical connector according to claim 1, wherein the one or more parts tat are flexibly moveable extend at least partly into the contact region.

4. The electrical connector according to claim 1, wherein the two halves of the second electrical connector are identical.

5. The electrical connector according to claim 1, wherein the one or more parts that are flexibly moveable are arranged such tat when mated with the second electrical connector the one or more parts that are flexibly moveable guide the second electrical connector.

6. The electrical connector according to claim 5, wherein the one or more parts that are flexibly moveable guide the second electrical connector such that its contacts are guided to the corresponding contacts of the first electrical connector.

7. An electrical connector comprising:

a first electrical connector having a plurality of side walls mounted on a first circuit board, at least one of the side walls having a flexibly moveable part, the flexibly moveable part is displaced by a second electrical connector mounted on a second circuit board and mated between the side walls of the first electrical connector such that a space is formed between the side wall having the flexibly moveable part and the second electrical connector, the second electrical connector includes a first and second connector half, the first connector halt disposed on a first side of the second circuit board and the second connector half disposed on a second opposing side of the second circuit board.

8. The electrical connector of claim 7, wherein the second circuit board is parallel to the side wall having the flexibly moveable part.

9. The electrical connector of claim 7, wherein the flexibly moveable part is separated from the side wall by slots.

10. The electrical connector of claim 7, wherein the flexibly moveable part includes a catch for guiding the second electrical connector.

* * * * *